US010258158B2

(12) United States Patent
Fei et al.

(10) Patent No.: US 10,258,158 B2
(45) Date of Patent: Apr. 16, 2019

(54) DUAL MOTOR LIFT CHAIR FOR THE ELDERLY

(71) Applicants: Zhong Qiang Fei, Jiaxing (CN); Xi Qi Sun, Jiaxing (CN); Wei Zhong Chu, Jiaxing (CN); Shao Qiang Fei, Jiaxing (CN)

(72) Inventors: Zhong Qiang Fei, Jiaxing (CN); Xi Qi Sun, Jiaxing (CN); Wei Zhong Chu, Jiaxing (CN); Shao Qiang Fei, Jiaxing (CN)

(73) Assignee: Haining Meihui Machinery LLC, Jiaxing (CN)

( * ) Notice: Subject to any disclaimer, the term of this patent is extended or adjusted under 35 U.S.C. 154(b) by 0 days.

(21) Appl. No.: 15/681,389

(22) Filed: Aug. 20, 2017

(65) Prior Publication Data

US 2018/0360217 A1 Dec. 20, 2018

(30) Foreign Application Priority Data

Jun. 19, 2017 (CN) ..... 2017 1 0463006

(51) Int. Cl.
*A47C 1/024* (2006.01)
*A47C 1/0355* (2013.01)
*A61G 5/04* (2013.01)

(52) U.S. Cl.
CPC ..... *A47C 1/0242* (2013.01); *A47C 1/0355* (2013.01); *A61G 5/04* (2013.01)

(58) Field of Classification Search
CPC ..... A47C 1/0242; A47C 1/0355; A61G 5/04
See application file for complete search history.

(56) References Cited

U.S. PATENT DOCUMENTS 3,138,402 A * 6/1964 Heyl, Jr. ..... A61G 5/14 297/325
3,476,495 A * 11/1969 Church ..... A47C 1/0355 297/330
4,007,960 A * 2/1977 Gaffney ..... A47C 1/03211 297/330

(Continued)

FOREIGN PATENT DOCUMENTS

CN 201286496 Y 8/2009
CN 203676556 U 7/2014

(Continued)

*Primary Examiner* — James M Ference
(74) *Attorney, Agent, or Firm* — Minder Law Group; Willy H. Wong

(57) ABSTRACT

The present invention discloses a dual motor lift chair for the elderly, which comprises a base, a seat lift, a back flexing mechanism and a leg flexing mechanism. The seat lift is arranged on the base, and the back flexing mechanism and the leg flexing mechanism are arranged on the seat lift. The present invention has a reasonable structure. When in the standing assistance configuration, the overall height of the lift chair increases, and the lift chair inclines forward at a certain angle, so that the center of gravity of the elderly rises and moves forward. Hence, an effective result of standing assistance is achieved, and the experience effect of the standing assistance is ensured. Furthermore, by setting the leg flexing mechanism and the back flexing mechanism, the flex of the body may be adjusted, and hence the comfortability of the chair is improved.

11 Claims, 6 Drawing Sheets

(56) References Cited

U.S. PATENT DOCUMENTS 4,083,599 A * 4/1978 Gaffney ..... A61G 5/14 248/393
4,249,774 A * 2/1981 Andreasson ..... A61G 5/14 297/311
4,365,836 A * 12/1982 Jackson ..... A47C 1/03211 297/330
4,386,803 A * 6/1983 Gilderbloom ..... A47C 1/022 297/330
4,852,939 A * 8/1989 Krauska ..... A47C 1/0242 297/71
5,013,084 A * 5/1991 May ..... A47C 1/0355 297/85 R
5,042,487 A * 8/1991 Marquardt ..... A61B 6/0457 378/17
5,061,010 A * 10/1991 LaPointe ..... A61G 5/14 297/325
5,219,204 A * 6/1993 Bathrick ..... A47C 1/0355 297/321
5,265,935 A * 11/1993 Geisler ..... A61G 5/14 297/325
5,346,280 A * 9/1994 Deumite ..... A61G 5/14 180/907
5,520,439 A * 5/1996 Blount ..... A47C 1/0345 297/330
5,582,457 A * 12/1996 Komorowski ..... A47C 1/0345 297/423.35
5,651,580 A * 7/1997 LaPointe ..... A47C 1/0355 297/325
5,806,920 A * 9/1998 Blount ..... A61G 5/14 297/330
5,845,961 A * 12/1998 LaPointe ..... A47C 1/0345 297/75
5,984,411 A * 11/1999 Galumbeck ..... A61G 5/14 297/330
6,000,758 A * 12/1999 Schaffner ..... A47C 1/0345 297/180.12
6,213,554 B1 * 4/2001 Marcoux ..... A61G 5/14 297/330
6,557,940 B2 * 5/2003 Hayashi ..... A61G 5/14 297/330
6,659,556 B2 * 12/2003 Pellerin ..... A61G 5/14 297/330
6,840,575 B2 * 1/2005 Hesse ..... A47C 1/0355 297/75
6,846,042 B2 * 1/2005 Hanson ..... A61G 5/006 297/115
7,021,713 B2 * 4/2006 Kao ..... A61G 5/14 297/338
7,090,297 B2 * 8/2006 Mohn ..... A61G 5/14 297/330
7,543,885 B2 * 6/2009 Pollard ..... A47C 1/0355 297/85 R
8,308,228 B2 * 11/2012 Lawson ..... A47C 1/035 297/330
8,403,409 B2 * 3/2013 Pollard ..... A47C 1/0355 297/85 M
8,459,732 B2 * 6/2013 LaPointe ..... A47C 3/02 297/260.2
8,459,733 B2 * 6/2013 Hoffman ..... A47C 1/0355 297/362.11
9,016,788 B1 * 4/2015 Pollard ..... A47C 1/0355 297/330
9,289,338 B1 * 3/2016 Swenson ..... B62D 55/075
2006/0061148 A1 * 3/2006 Pollard ..... A47C 1/0355 297/85 M
2009/0174251 A1 * 7/2009 Lawson ..... A47C 1/0355 297/85 R
2010/0072805 A1 * 3/2010 Qiu ..... A47C 1/0355 297/85 R
2011/0121625 A1 * 5/2011 Lipford ..... A61G 5/14 297/311
2011/0175404 A1 * 7/2011 Lawson ..... A47C 1/0355 297/83
2011/0175426 A1 * 7/2011 Lawson ..... A47C 1/0355 297/85 M
2012/0049606 A1 * 3/2012 Lawson ..... A47C 1/0355 297/85 M
2012/0286557 A1 * 11/2012 Hoffman ..... A47C 1/0355 297/85 M
2013/0175847 A1 * 7/2013 Lawson ..... A61G 5/14 297/85 M
2014/0021760 A1 * 1/2014 Masters ..... A61G 5/14 297/313
2014/0049084 A1 * 2/2014 Lawson ..... A47C 1/032 297/340
2014/0333099 A1 * 11/2014 Lu ..... A47C 1/0355 297/83
2015/0076891 A1 * 3/2015 LaPointe ..... A47C 31/008 297/85 M
2015/0282619 A1 * 10/2015 Lawson ..... A47C 1/0355 297/83
2016/0022040 A1 * 1/2016 Lawson ..... A47C 1/03211 297/68

FOREIGN PATENT DOCUMENTS

CN 203676560 U 7/2014
CN 203723733 U 7/2014
CN 203802043 U 9/2014
CN 204015663 U 12/2014
CN 204889251 U 12/2015
CN 103598748 B 4/2016
CN 106667116 A 5/2017

* cited by examiner

DUAL MOTOR LIFT CHAIR FOR THE ELDERLY

RELATED APPLICATIONS

This application claims priority to China Patent Application No. CN 2017104630066, filed Jun. 19, 2017.

The applications and all patents, patent applications, articles, books, specifications, other publications, documents, and things referenced herein are hereby incorporated herein in their entirety for all purposes. To the extent of any inconsistency or conflict in the definition or use of a term between any of the incorporated publications, documents, or things and the text of the present document, the definition or use of the term in the present document shall prevail.

BACKGROUND OF THE INVENTION

Field of Invention

The present invention relates to chairs, and more particularly to a dual motor lift chair for the elderly.

Related Art

One prior art electric lift chair comprises a base frame, and a footrest lift mechanism, a back tilt mechanism, a standing assistance mechanism, a cushion lift mechanism and a linkage transmission mechanism are installed on the base frame. The standing assistance mechanism is installed on both sides of the base frame, and each standing assistance mechanism is correspondingly equipped with one cushion lift mechanism. A footrest lift mechanism is installed on each cushion lift mechanism, and the linkage transmission mechanism is connected to the footrest lift mechanism and the back tilt mechanism. Although the chair for the elderly described in the patent has the standing assistance function and a certain usage effectiveness is achieved, it still has some disadvantages. The main issue is that, during the use of the electric lift chair for the elderly described in the patent, despite the standing assistance function is achieved by lifting the height of the rear part of the chair, the center of gravity of the elderly is still relatively low. Therefore, it is still difficult for the elderly to stand up. In practice, the experience of the standing assistance function of this electric lift chair for the elderly is poor.

SUMMARY OF THE INVENTION

In view of this, one objective of one embodiment of the present invention is aimed to provide a dual motor lift chair for the elderly with a reasonable structure. For a further objective of one embodiment of the dual motor lift chair for the elderly, the standing assistance function is achieved by lifting the chair body and making the chair body incline forward. Hence, the usage effectiveness of the standing assistance is improved, and this chair for the elderly also has a leg flexing assistance function and a backrest adjusting function in the fore-and-aft direction.

One embodiment of the technical proposal to achieve the present invention is:

A dual motor lift chair for the elderly comprises a base, a seat lift, a back flexing mechanism and a leg flexing mechanism. The seat lift is arranged on the base, and the back flexing mechanism and the leg flexing mechanism are arranged on the seat lift. Anchors are symmetrically fixed on the left and right sides of the middle of the base, and there is a prop on the top of each anchor.

The seat lift comprises first lift frames, second lift frames, lift linkages, an electric pushrod, front yokes and side frames. The rear ends of the first lift frame and of the lift linkage are all hinged to the anchor, and the front ends of the first lift frame and of the lift linkage are all hinged to the front yoke. The front ends of the second lift frame are fixedly connected to the front yoke. Two side frames are fixed to the two sides of the second lift frames. Each side frame has a seating plate fixed to the chair body, and the front ends of the two side frames are fixedly connected through the first beam. A drive rod is rotatably arranged on the rear end of the second lift frame, along the width direction of the second lift frame. The electric pushrod is of a long strip shape, and one of its ends is hinged to the rear end of base. On the electric pushrod, there is a slider which is driven by the motor to move along the lengthwise direction of the electric pushrod. The slider is connected to the drive rod through the coupler. The first drive plate is fixed to both ends of the drive rod. The first drive plates, after rotating backward a certain angle, abut on the top of the second lift frames. The leg flexing mechanism is installed at the front part of the side frame. The first drive plates interlock with the leg flexing mechanism through the drive link. When the first drive plate rotates forward or backward, the leg flexing mechanism is driven by the drive link to extend or retract. When the seat lift fully retracts, the rear end of the second lift frames falls on the prop. A first limiting pin is fixed onto the side frame, and when the leg flexing mechanism fully retracts, it abuts on the first limiting pin.

The back flexing mechanism is installed at the rear part of the second lift frame. It comprises second drive plates, aft braces, backrests, which are symmetrically arranged on the left and right sides, and a linear actuator. One end of the second drive plate is hinged to the side frame, and the other end of the second drive plate is hinged to the lower end of the aft brace. The upper end of the aft brace is hinged to the rear part of the lower end of the backrest, and the front part of the lower end of the backrest is hinged to the top part of the rear end of the side frame. Two second drive plates, on the left and right sides, are fixedly connected to each other through the second beam. One end of the linear actuator is connected to the first mounting hub on the first beam, and the other end is connected to the second mounting hub on the second beam.

In one embodiment of the dual motor lift chair, the side frame comprises a front brace, a side bracket, a curved strut, a stiffener, and a rear hitch plate. The side bracket is arranged along the lengthwise direction of the second lift frame. One end of the curved strut is connected to the side bracket, and the other end is connected to the upper end of the front brace. The lower end of the front brace is connected to the front yoke. One end of the stiffener is connected to the side bracket, and the other end is connected to the middle of the curved strut. The rear hitch plate is fixed to the rear end of the second lift frame, and the lower part of the rear end of the side bracket is connected to the rear hitch plate. The first limiting pin is fixed onto the curved strut. The front part of the lower end of the backrest is hinged to the top part of the rear end of the side bracket. A second limiting pin is also fixed to the top part of the rear end of the side bracket. A limiter is arranged on the bottom part of the backrest. When the back flexing mechanism fully retracts, the limiter abuts on the second limiting pin.

The embodiments of the present invention have positive effectiveness with a reasonable structural design. When in the standing assistance configuration, the overall height of the lift chair increases, and the lift chair inclines forward at a certain angle, so that the center of gravity of the elderly rises and moves forward. Hence, an effective standing assistance function is achieved, and a positive experience of the standing assistance function is ensured. Furthermore, because of the leg flexing mechanism and the back flexing mechanism, the leg flexing, as well as the fore-and-aft position of the back may be adjusted, and hence the comfort of the chair is improved.

DETAILED DESCRIPTION OF THE INVENTION

Figure 1:
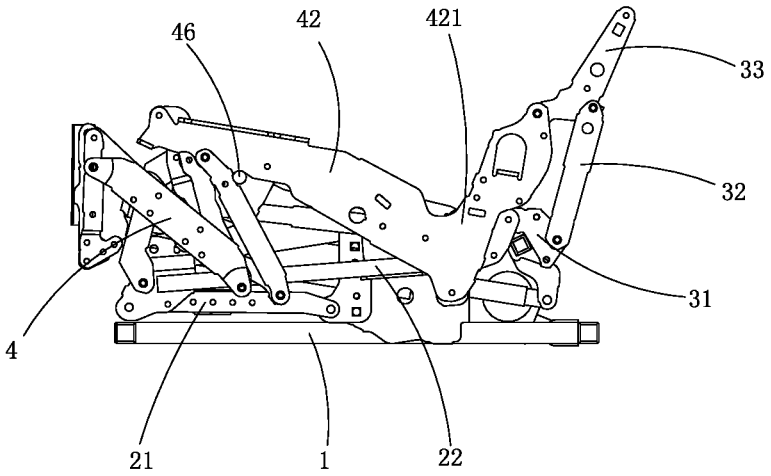
FIG. 1 is a side view of one embodiment of the dual motor lift chair in the present invention when fully retracted.
Figure 2:
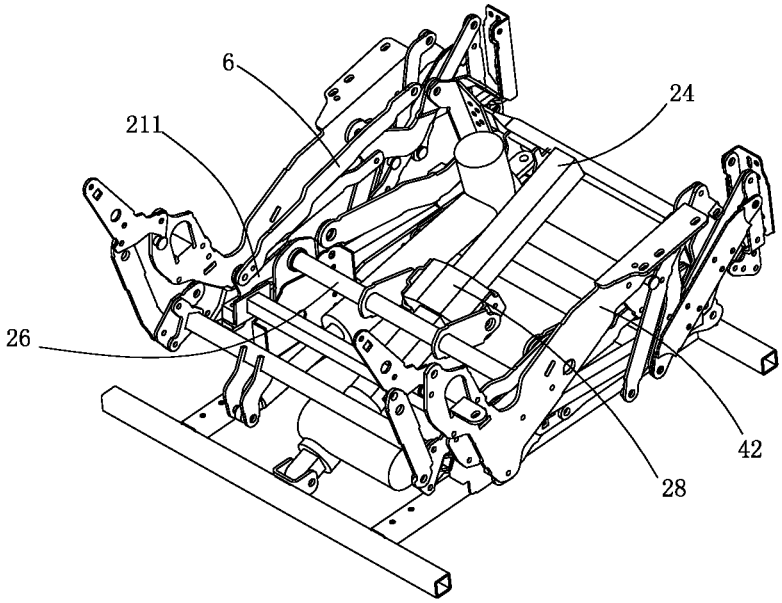
FIG. 2 is a perspective view of one embodiment of the dual motor lift chair in FIG. 1.
Figure 3:
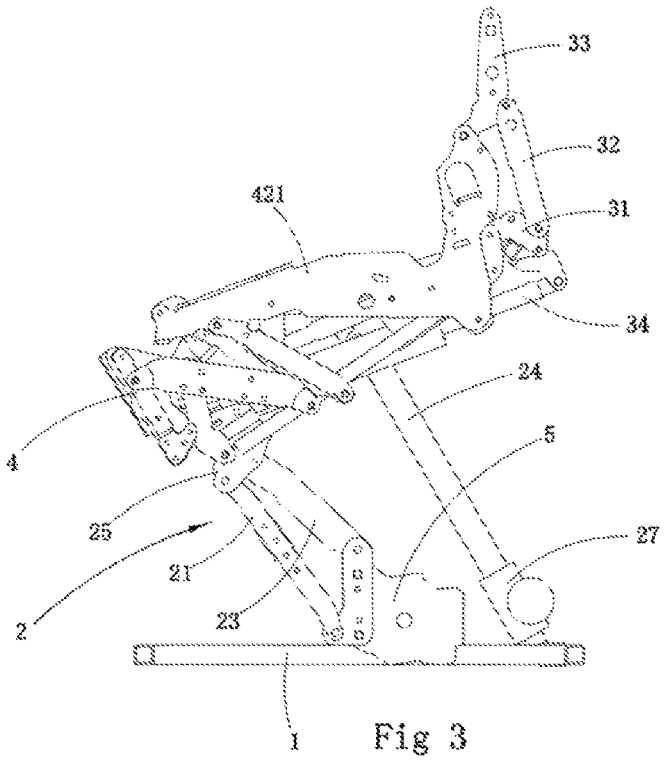
FIG. 3 is a side view of one embodiment of the dual motor lift chair in the present invention in the standing assistance configuration.
Figure 4:
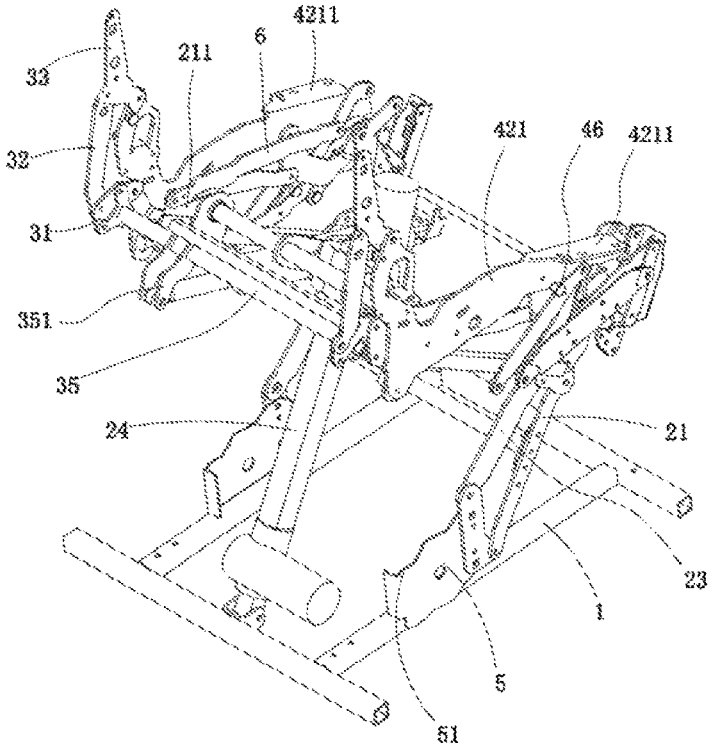
FIG. 4 is a perspective view of one embodiment of the dual motor lift chair in FIG. 3.
Figure 5:
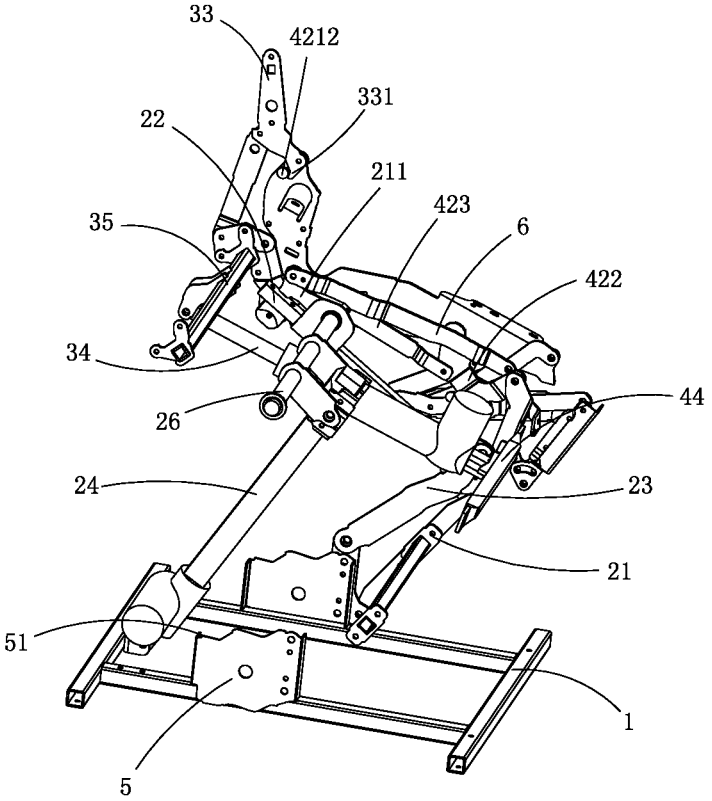
FIG. 5 is a schematic view of one embodiment of the dual motor lift chair in FIG. 4 with some parts omitted.
Figure 6:
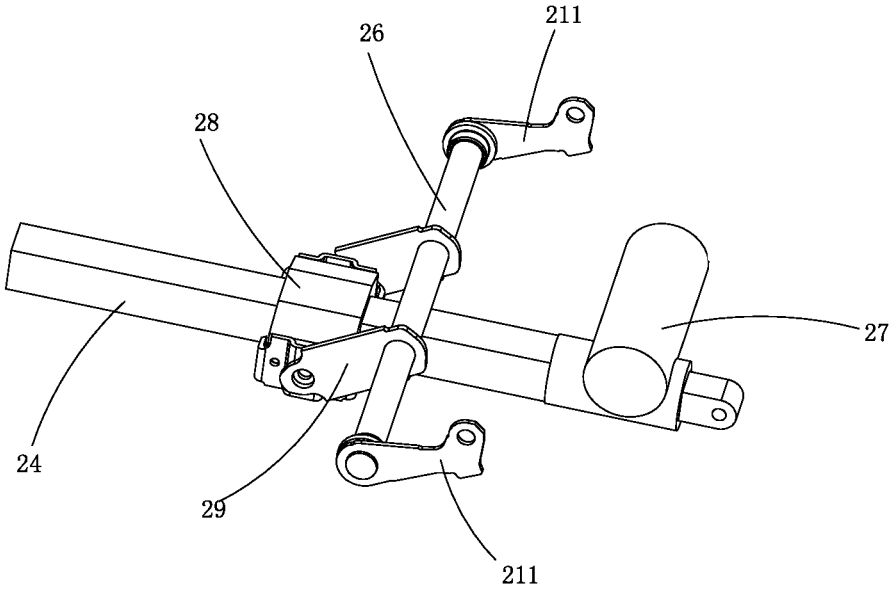
FIG. 6 is a schematic view when the electric pushrod (with the slider on it at the initial position), the drive rod, and the drive plates are mating in one embodiment of the present invention.
Figure 7:
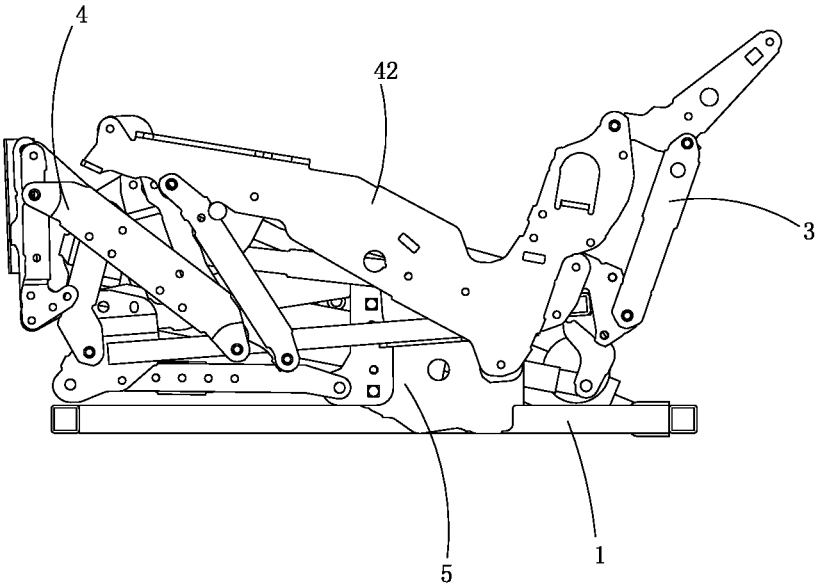
FIG. 7 is a side view of one embodiment of the dual motor lift chair in the present invention when the back flexing mechanism is inclined.
Figure 8:
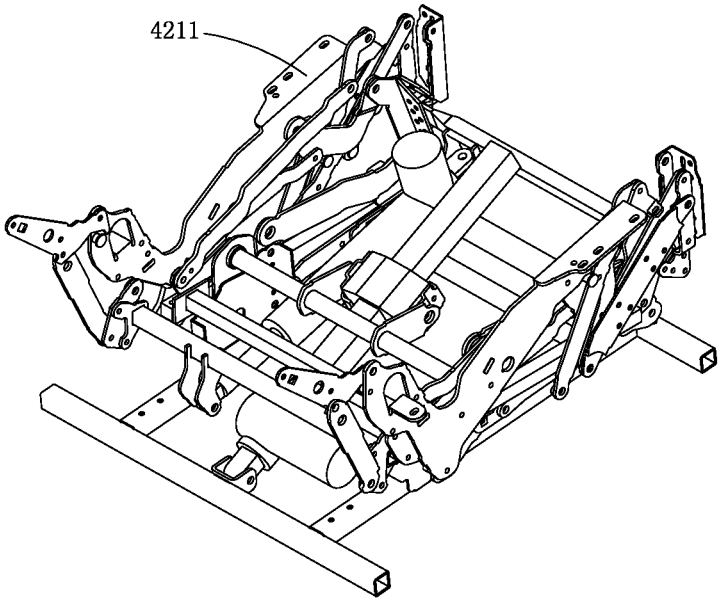
FIG. 8 is a perspective view of one embodiment of the dual motor lift chair in FIG. 7.
Figure 9:
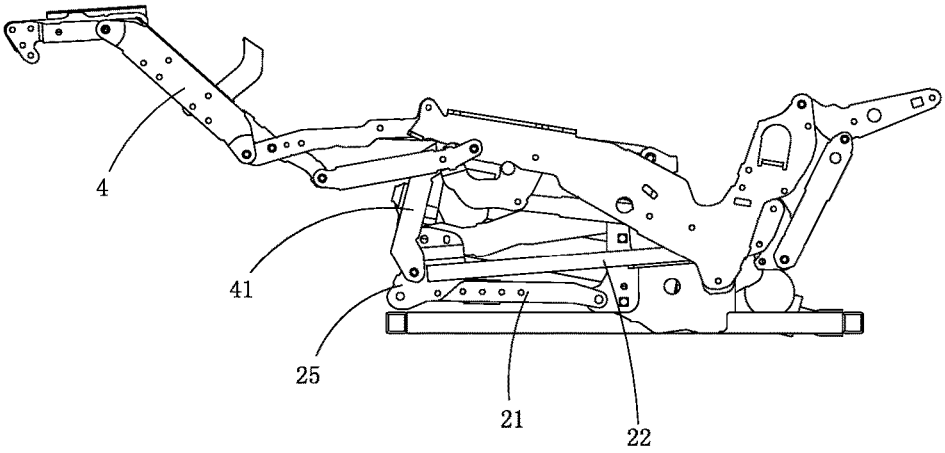
FIG. 9 is a side view of one embodiment of the dual motor lift chair in the present invention when the back flexing mechanism is inclined and the leg flexing mechanism is fully extended.
Figure 10:
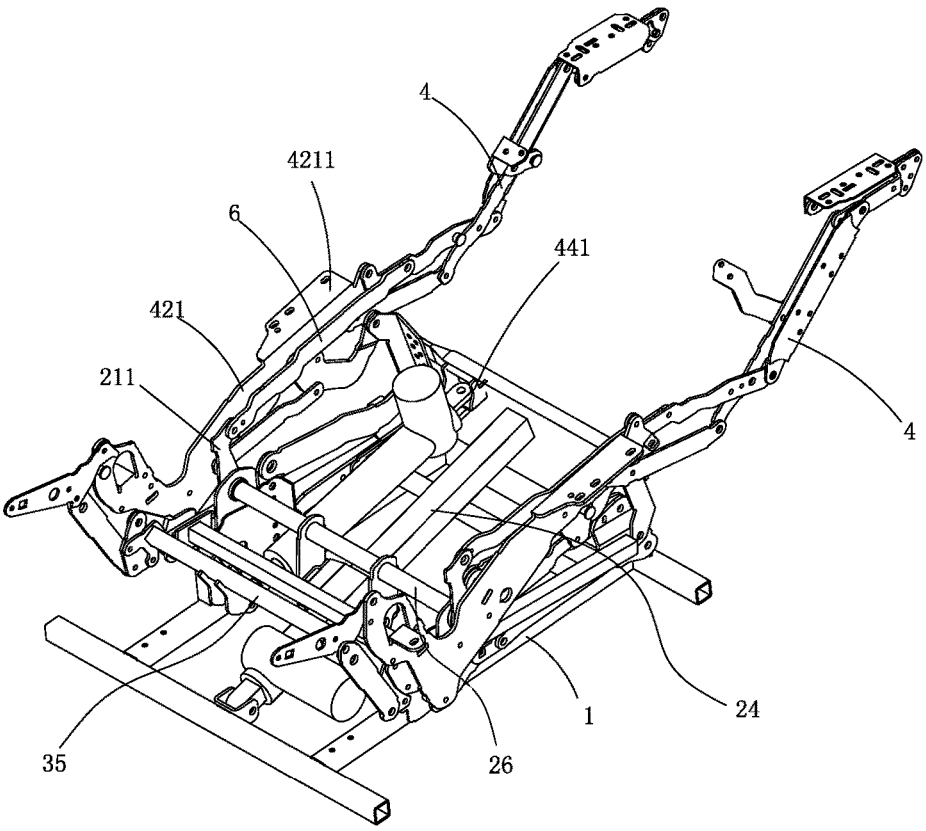
FIG. 10 is a perspective view of one embodiment of the dual motor lift chair in FIG. 9.

The specific structure in one embodiment of the present invention, combined with the appended drawing in the specification, is described below:

One embodiment of the dual motor lift chair for the elderly, as shown in FIG. 1 through FIG. 10, comprises a base (1), a seat lift (2), a back flexing mechanism (3) and a leg flexing mechanism (4). The seat lift (2) is arranged on the base (1), and the back flexing mechanism (3) and a leg flexing mechanism (4) are arranged on the seat lift (2). Anchors (5) are symmetrically fixed on the left and right sides of the middle of the base (1), and there is a prop (51) on the top of each anchor (5). The seat lift (2) comprises first lift frames (21), second lift frames (22), lift linkages (23), an electric pushrod (24), front yokes (25) and side frames (42). The rear ends of the first lift frame (21) and of the lift linkage (23) are all hinged to the anchor (5), and the front ends of the first lift frame (21) and of the lift linkage (23) are all hinged to the front yoke (25). The front ends of the second lift frame (22) are fixedly connected to the front yoke (25). Two side frames (42) are fixed to the two sides of the second lift frames (22). Each side frame (42) has a seating plate (4211) fixed to the chair body, and the front ends of the two side frames (42) are fixedly connected through the first beam (44). A drive rod (26) is rotatably arranged on the rear end of the second lift frame (22), along the width direction of the second lift frame (22). The electric pushrod (24) is of a long strip shape, and one of its ends is hinged to the rear end of base (1). On the electric pushrod (24), there is a slider (28) which is driven by the motor (27) to move along the lengthwise direction of the electric pushrod (24). The slider (28) is connected to the drive rod (26) through the coupler (29). The first drive plate (211) is fixed to both ends of the drive rod (26). The first drive plates (211), after rotating backward a certain angle, abut on the top of the second lift frames (22). The leg flexing mechanism (4) is installed at the front part of the side frame (42). The first drive plates (211) interlock with the leg flexing mechanism (4) through the drive link (6). When the first drive plate (211) rotates forward or backward, the leg flexing mechanism (4) is driven by the drive link (6) to extend or retract. When the seat lift (2) fully retracts, the rear end of the second lift frames (22) falls on the prop (51), and the front yoke (25) falls on the front part of the base (1). A first limiting pin (46) is fixed onto the side frame (42), and when the leg flexing mechanism (4) fully retracts, it abuts on the first limiting pin (46). The back flexing mechanism (3) is installed at the rear part of the second lift frame (22). It comprises second drive plates (31), aft braces (32), backrests (33), which are symmetrically arranged on the left and right sides, and a linear actuator (34). One end of the second drive plate (31) is hinged to the side frame (42), and the other end of the second drive plate (31) is hinged to the lower end of the aft brace (32). The upper end of the aft brace (32) is hinged to the rear part of the lower end of the backrest (33), and the front part of the lower end of the backrest (33) is hinged to the top part of the rear end of the side frame (42). Two second drive plates (31), on the left and right sides, are fixedly connected to each other through the second beam (35). One end of the linear actuator (34) is connected to the first mounting hub (441) on the first beam (44), and the other end is connected to the second mounting hub (351) on the second beam (35). The present invention has a reasonable structure. When in the standing assistance configuration, the overall height of the lift chair increases, and the lift chair inclines forward at a certain angle (see FIG. 3), so that the center of gravity of the elderly rises and moves forward. Hence, an effective result of standing assistance is achieved, and the effect of the standing assistance is ensured. Furthermore, because of the leg flexing mechanism and the back flexing mechanism, the flex of the leg, as well as the fore-and-aft position of the back may be adjusted, and hence the comfortability of the chair is improved. The leg flexing mechanism used in this embodiment may be the same as that used in the prior art. Therefore, the details are not described here.

Figure 11:
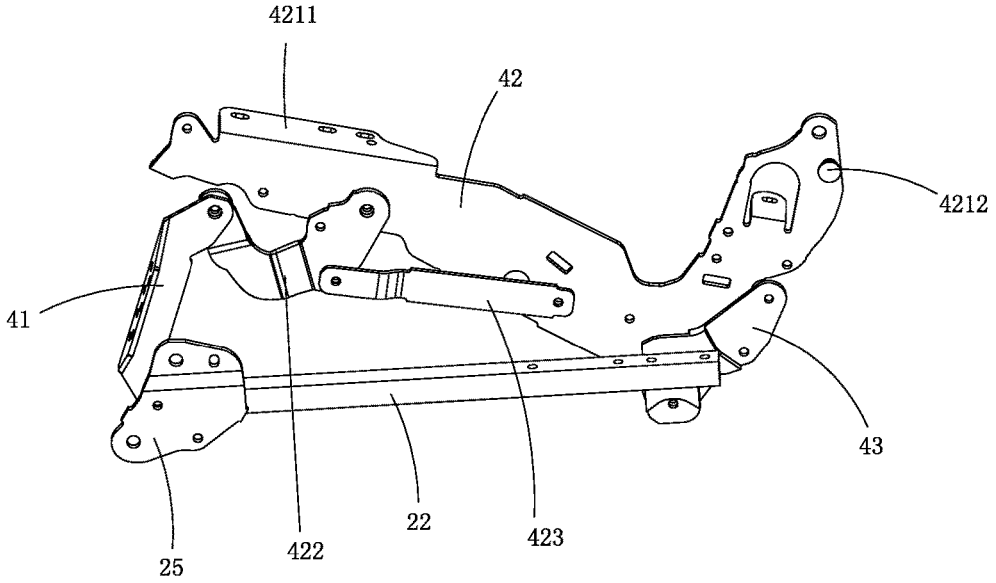
FIG. 11 is a schematic view of the side frame of one embodiment of the dual motor lift chair in the present invention.

As shown in FIG. 11, in one embodiment, the side frame (42) comprises a front brace (41), a side bracket (421), a curved strut (422), a stiffener (423), and a rear hitch plate (43). The side bracket (421) is arranged along the lengthwise direction of the second lift frame (22). One end of the curved strut (422) is connected to the side bracket (421), and the other end is connected to the upper end of the front brace (41). The lower end of the front brace (41) is connected to the front yoke (25). One end of the stiffener (423) is connected to the side bracket (421), and the other end is connected to the middle of the curved strut (422). The rear hitch plate (43) is fixed to the rear end of the second lift frame (22), and the lower part of the rear end of the side bracket (421) is connected to the rear hitch plate (43). The first limiting pin (46) is fixed onto the curved strut (422). The front part of the lower end of the backrest (33) is hinged to the top part of the rear end of the side bracket (421). A second limiting pin (4212) is also fixed to the top part of the rear end of the side bracket (421). A limiter (331) is arranged on the bottom part of the backrest (33). When the back flexing mechanism (3) fully retracts, the limiter (331) abuts on the second limiting pin (4212). In this embodiment, with the design that the leg flexing mechanism (4) abuts on the first limiting pin (46) when fully retracted, and that the upper limiter (331) of the back flexing mechanism (3) abuts on the second limiting pin (4212) when fully retracted, the use stability can be improved.

In one embodiment, the principle of movement of the chair for the elderly is that:

First, when the chair for the elderly is in the fully retracted state (hereinafter referred to as First State; see FIG. 1 and FIG. 2), the first lift frame (21) overlaps with the second lift frame (22), and the back flexing mechanism (3) and the leg flexing mechanism (4) are fully retracted. At this point, the first drive plate (211) moves backward to abut on the upper part of the second lift frame (22). When it is required to switch from the First State to the Second State (i.e. the Standing State; see FIG. 3 and FIG. 4), the electric pushrod (24) is controlled to drive the slider (28) to move forward from the initial position. During this process, the first drive plate (211) always abuts on the second lift frame (22). Later, with the slider (28) further moving forward, the second lift frame (22) and the first lift frame (21) are lifted gradually, and hence the Second State is reached. When it is required to switch from the Second State to the First State, the electric pushrod (24) is simply controlled to drive the slider (28) to move backward, to the initial position. When it is required to switch from the First State to the Third State (i.e. the state when the back flexing mechanism (3) inclines backward and extends; see FIG. 7 and FIG. 8), control the linear actuator (34) to retract, then, though the rotation of the second beam (35), to drive the second drive plate (31) to rotate backward and then, through the aft brace (32), to drive the backrest (33) to rotate backward, till the Third State is reached. When the Third State is switched to the First State, the linear actuator (34) is simply controlled to extend. When it is required to switch from the First State to the Fourth State (i.e. the state when the leg flexing mechanism (4) is fully extended; see FIG. 9 and FIG. 10), control the electric pushrod (24) to drive the slider (28) to move backward from the initial position, then, through the rotation of the drive rod (26), to drive the first drive plate (211) to rotate forward and then, during the process of the first drive plate (211) being rotated forward, and, through the drive link (6), to drive the leg flexing mechanism (4) to unfold. When the Fourth State is switched to the Third State, the electric pushrod (24) is simply controlled to drive the slider (28) to move forward to the initial position. When the slider (28) reaches the initial position, the leg flexing mechanism (4) is fully retracted. If it is required to switch from the Second State to the Fourth State, the Second State needs to be switched to the First State, and then to the Fourth State. Conversely, if it is required to switch from the Fourth State to the Second State, the Fourth State needs to be switched to the First State, and then to the Second State.

Obviously, the description of the embodiments thereof serves only as an illustration to explain the nature of the invention, rather than limiting the embodiments of the present invention. For those skilled in the art, various changes or revisions in different forms, on the basis of the description above, may be made therein. It is neither necessary nor able to exhaustively describe every embodiment. It is to be understood that, any apparent changes or revisions derived from the essential spirit of the present invention are still in the protection scope of the present invention.

LIST OF REFERENCE NUMERALS

1 Base
2 Seat Lift
21 First Lift Frame
211 First Drive Plate
22 Second Lift Frame
23 Lift Linkage
24 Electric Pushrod
25 Front Yoke
26 Drive Rod
27 Motor
28 Slider
29 Coupler
3 Back Flexing Mechanism
31 Second Drive Plate
32 Aft Brace
33 Backrest
331 Limiter
34 Linear Actuator
35 Second Beam
351 Second Mounting Hub
4 Leg Flexing Mechanism
41 Front Brace
42 Side Frame
421 Side Bracket
4211 Seating Plate
4212 Second Limiting Pin
422 Curved Strut
423 Stiffener
43 Rear Hitch Plate
44 First Beam
441 First Mounting Hub
46 First Limiting Pin
5 Anchor
51 Prop
6 Drive Link

What is claimed is:

1. A dual motor lift chair having a chair body, comprising:
a base (1);
a seat lift (2) arranged on the base (1);
anchors (5) symmetrically fixed on a left side and a right side of a middle of the base (1);
a prop (51) on a top of each of the anchors (5);
front yokes (25) of the seat lift (2);
first lift frames (21) of the seat lift (2), a rear end of each of the first lift frames (21) hinged to one of the anchors (5), a front end of each of the first lift frames (21) hinged to one of the front yokes (25);
second lift frames (22) of the seat lift (2), a front end of each of the second lift frames (22) fixedly connected to one of the front yokes (25);
lift linkages (23) of the seat lift (2), a rear end of each of the lift linkages (23) hinged to one of the anchors (5), a front end of each of the lift linkages (23) hinged to the one of the front yokes (25);
an electric pushrod (24) of the seat lift (2), the electric pushrod (24) having a long strip shape, one end of the electric pushrod (24) hinged to a rear end of base (1);
a drive rod (26) rotatably arranged on a rear end of each of the second lift frames (22), along a width direction of second lift frames (22);

a slider (28) on the electric pushrod (24), the slider (28) driven by a motor (27) to move along a lengthwise direction of the electric pushrod (24), the slider (28) connected to the drive rod (26) through a coupler (29);

side frames (42) of the seat lift (2), two of the side frames (42) fixed to two sides of the second lift frames (22), a front end of each of the two side frames (42) fixedly connected through a first beam (44);

a leg flexing mechanism (4) arranged on the seat lift (2), the leg flexing mechanism (4) installed at a front part of each of the side frames (42);

a seating plate (4211) of each of the side frames (42) fixed to the chair body;

first drive plates (211) fixed to two ends of the drive rod (26), the first drive plates (211) abut on a top of the second lift frames (22) after rotating backward a certain angle, the first drive plates (211) interlocking with the leg flexing mechanism (4) through a drive link (6);

a first limiting pin (46) fixed onto at least one of the side frames (42);

a back flexing mechanism (3) arranged on the seat lift (2), the back flexing mechanism (3) installed at a rear part of each of the second lift frames (22);

backrests (33) of the back flexing mechanism (3), the backrests (33) symmetrically arranged on a left side and a right side of the chair, a front part of the lower end of each of the backrests (33) hinged to a top part of a rear end of each of the side frames (42);

aft braces (32) of the back flexing mechanism (3), an upper end of each of the aft braces (32) hinged to a rear part of a lower end of one of the backrests (33);

second drive plates (31) of the back flexing mechanism (3), a first end of each of the second drive plates (31) hinged to one of the side frames (42), a second end of each of the second drive plates (31) hinged to a lower end of one of the aft braces (32), the second drive plates (31) arranged on a left side and a right side of the chair fixedly connected to each other through a second beam (35); and a linear actuator (34) of the back flexing mechanism (3), a first end of the linear actuator (34) connected to a first mounting hub (441) on the first beam (44), a second end of the linear actuator (34) connected to a second mounting hub (351) on the second beam (35);

wherein when the first drive plates (211) rotate forward or backward, the leg flexing mechanism (4) is driven by the drive link (6) to extend or retract;

wherein when the seat lift (2) fully retracts, a rear end of each of the second lift frames (22) falls on the props (51); and wherein when the leg flexing mechanism (4) fully retracts, the leg flexing mechanism (4) abuts the first limiting pin (46).

2. The dual motor lift chair of claim 1, further comprising:

a front brace (41) of the side frames (42), a lower end of the front brace (41) connected to one of the front yokes (25).

3. The dual motor lift chair of claim 2, further comprising:

a side bracket (421) of the side frames (42), the side bracket (421) arranged along a lengthwise direction of the second lift frames (22).

4. The dual motor lift chair of claim 3, wherein a front part of a lower end of each of the backrests (33) is hinged to a top part of a rear end of the side bracket (421).

5. The dual motor lift chair of claim 4, further comprising:

a curved strut (422) of the side frames (42), a first end of the curved strut (422) connected to the side bracket (421), a second end of the curved strut (422) connected to an upper end of the front brace (41).

6. The dual motor lift chair of claim 5, wherein the first limiting pin (46) is fixed onto the curved strut (422).

7. The dual motor lift chair of claim 6, further comprising:

a stiffener (423) of the side frames (42), a first end of the stiffener (423) connected to the side bracket (421), a second end of the stiffener (423) connected to a middle of the curved strut (422).

8. The dual motor lift chair of claim 7, further comprising:

a rear hitch plate (43) of the side frames (42), the rear hitch plate (43) fixed to a rear end of each of the second lift frames (22), the rear hitch plate (43) connected to a lower part of a rear end of the side bracket (421).

9. The dual motor lift chair of claim 8, further comprising:

a second limiting pin (4212) fixed to a top part of a rear end of the side bracket (421).

10. The dual motor lift chair of claim 9, further comprising:

a limiter (331) arranged on a bottom part of each of the backrests (33).

11. The dual motor lift chair of claim 10, wherein when the back flexing mechanism (3) fully retracts, the limiter (331) abuts the second limiting pin (4212).

* * * * *